US005851052A

United States Patent [19]

Gustafsson

[11] Patent Number: 5,851,052

[45] Date of Patent: Dec. 22, 1998

[54] FOLDABLE STOOL

[76] Inventor: Mats Gustafsson, Hamngatan 53A, S-531 34 Lidköping, Sweden

[21] Appl. No.: 955,943

[22] Filed: Oct. 22, 1997

[51] Int. Cl.[6] ..... A47C 4/28

[52] U.S. Cl. ..... 297/16.2; 297/45; 297/451.2; 248/164; 403/170

[58] Field of Search ..... 297/16.2, 45, 451.2; 248/164, 222.52, 431, 436; 403/169, 170, 217

[56] References Cited

U.S. PATENT DOCUMENTS

| | | | |
|---|---|---|---|
| 115,598 | 6/1871 | Free | 248/164 X |
| 615,476 | 12/1898 | Chapman | 297/45 X |
| 747,204 | 12/1903 | Mock . | |
| 772,316 | 10/1904 | Mock . | |
| 4,133,412 | 1/1979 | Hildebrandt | 248/164 X |
| 4,527,760 | 7/1985 | Salacuse | 248/222.52 X |
| 4,934,638 | 6/1990 | Davis | 248/164 |
| 5,709,428 | 1/1998 | Hugghins | 297/45 X |

*Primary Examiner*—Peter R. Brown
*Attorney, Agent, or Firm*—Rolf Fasth; Fasth Law Offices

[57] ABSTRACT

The foldable stool has a triangular shaped seat with three upper legs attached to the corners of the seat. A leg holder is attached to the bottom portion of each upper leg. The leg holders define a lateral opening that has an asymmetrical shape. A Y-shaped central connector units holds the leg holders together. The connector has irregular shaped extensions that are insertable into the irregular shaped lateral openings of the leg holder when the leg holder is turned into a first position. After being inserted, the leg holder may be rotated into a second position to securely hold the leg holder and so that the upper leg can be inserted into the leg holder and rest on a circular seat or flange that is disposed inside the leg holder. Lower legs are inserted into the leg holders. When it is desirable to collapse the foldable stool, the lower legs are pushed into the upper leg by pressing the knob to disengage the knob from the leg holder. The upper legs may also be moved together by collapsing the leather seat so that the upper legs are substantially parallel.

18 Claims, 4 Drawing Sheets

FOLDABLE STOOL

TECHNICAL FIELD

This invention relates to a foldable stool.

BACKGROUND INFORMATION AND SUMMARY OF THE INVENTION

It is often desirable to have a foldable and portable stool that may be easily transported from one place to another and used in a variety of outdoor conditions. It is also convenient to provide a portable stool that may be reduced to a small size for ease of carrying and storage. Folding stools have been developed in the past. However, the prior art folding stools have been unstable and difficult to fold and unfold. Sometimes, the prior art folding stools have also been heavy and clumsy.

The present invention provides a foldable stool that is stable and very easy to fold into a very small size. The foldable stool of the present invention can also conveniently be completely disassembled for easy cleaning or storage. The stool of the present invention has a linking mechanism for the legs that has many safety features to prevent any undesirable collapsing of the stool when a person is sitting on the stool. More particularly, the present invention is a foldable stool that has a triangular shaped seat with three upper legs attached to the corners of the seat. A leg holder is attached to the bottom portion of each upper leg. Each leg holder has a longitudinal opening defined therethrough. The leg holders also define a lateral opening that has an asymmetrical shape. A Y-shaped central connector unit rotatably holds the leg holders together. The connector has irregular shaped extensions that are insertable into the asymmetrically shaped lateral openings of the leg holder when the leg holder is turned into a first position. After the extension is inserted, the leg holder may be rotated into a second position to securely hold the leg holder and so that the upper leg can be inserted into the leg holder and rest on a circular seat or flange that is disposed inside the leg holder. A lower leg may be inserted from the opposite side of each leg holder until a spring biased knob on the lower leg snaps into a second lateral opening defined in the leg holder. When it is desirable to collapse the foldable stool of the present invention, the lower legs may be pushed into the upper leg by pressing the knob to disengage the knob from the leg holder. The upper legs may also be moved together by collapsing the leather seat so that the upper legs are substantially parallel. The upper legs may then be held together in the collapsed position by a strap.

DETAILED DESCRIPTION

Figure 1:
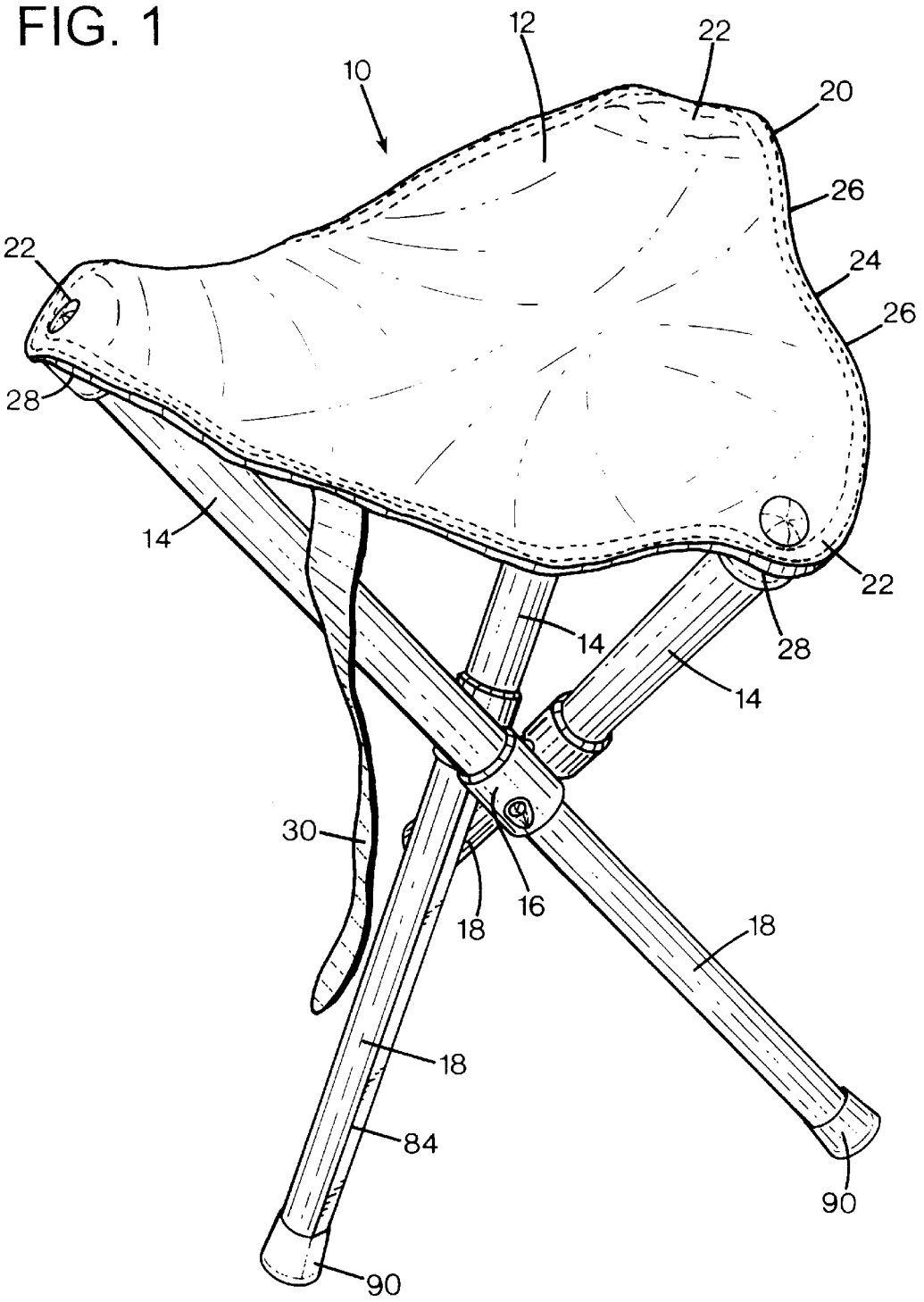
FIG. 1 is a perspective view of the foldable stool of the present invention in an expanded position.
Figure 3:
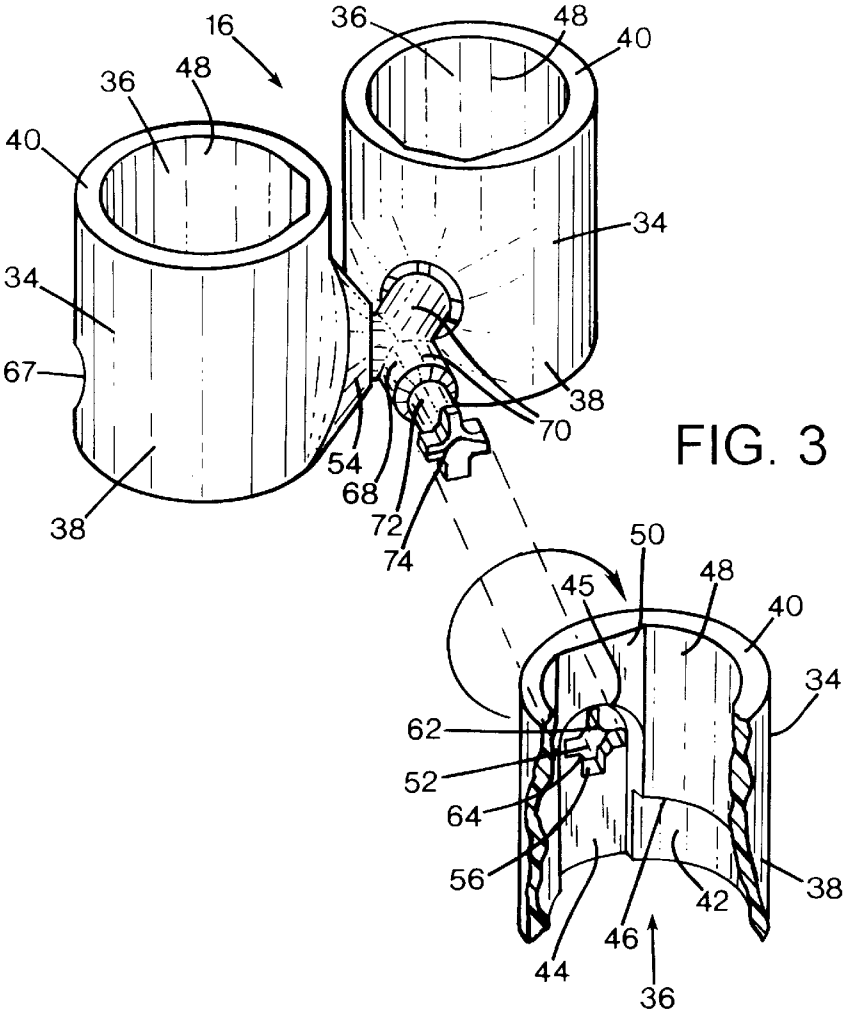
FIG. 3 is a perspective detail view of the linking mechanism of the present invention.
Figure 2:
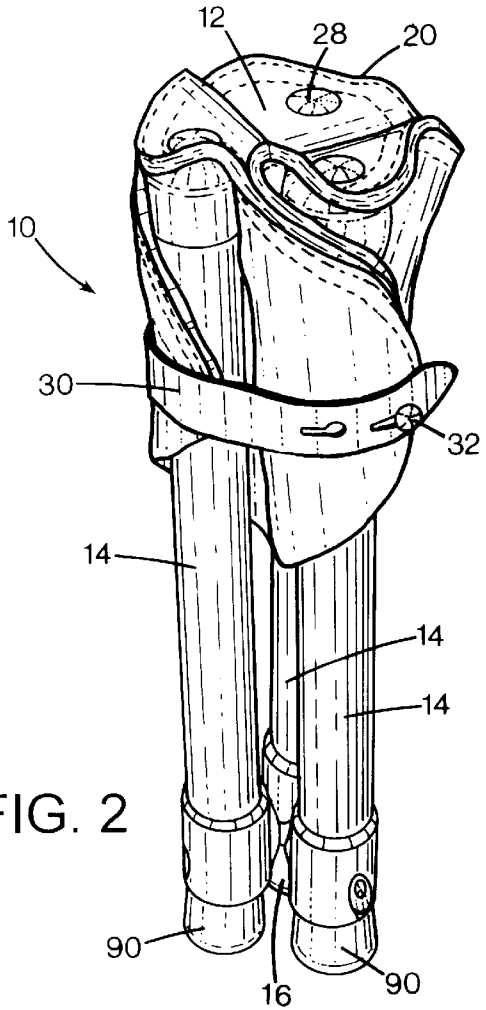
FIG. 2 is a perspective view of the foldable stool in a collapsed position.

With reference to FIGS. 1–7, the foldable stool 10 of the present invention has a seat portion 12 attached to three upper legs 14 that are converging towards and connected to a linking mechanism 16. Three lower legs 18 are removably attached to the linking mechanism 16. As described in detail below, the stool 10 may be collapsed from an expanded position, as shown in FIG. 1, to a collapsed folded position, as shown in FIG. 2.

The seat portion 12 is preferably triangular shaped and made of a sturdy flexible material such as a leather material. The seat portion has stitched side edges 20 and corners 22. The side edges 20 may each have a concave midsection 24 and concave side sections 26 disposed between the midsection 24 and the corners 22. Each corner has a plastic cover 28 attached to the seat portion 12. Inside the plastic covers 28 there are leg stabilizers disposed. A strap 30 is attached to the seat portion 12 at one of the side edges 20. The strap 30 has holes defined therein so that a knob 32 that is attached to an underside of the seat portion 12 may be tightly inserted into one of the openings when the stool 10 is in the collapsed position.

The upper legs 14 are preferably hollow cylinders made of a lightweight and strong material such as aluminum. An upper end of the upper legs 14 has a diameter that is dimensioned to tightly fit into the plastic covers 28. A lower end of the upper legs 14 is dimensioned to tightly fit into the linking mechanism 16, as described in detail below.

The linking mechanism 16 comprises three plastic leg holders 34 that are rotatably held together by a connector or joint member 68. Each holder 34 has a longitudinal opening 36 extending therethrough. The holder 34 has an upper end 38 and a lower end 40. The opening 36 at the upper end 38 has an inner wall 42 having a diameter $d_1$ (best seen in FIG. 7) that is designed to snugly receive a bottom end of the upper leg 14. The inner wall 42 may have a plurality of ribs disposed therein to prevent the upper legs 14 from undesirably rotating within the upper end 38. A longitudinal groove 44 is defined in the inner wall 42. The groove 44 ends at a semi-circular end section 45.

The lower end 40 has a diameter $d_2$ that is less than the diameter $d_1$ of the upper end 38 s0 that a circular flange or seat 46 is formed at a bottom of the upper end 38. The flange 46 supports the upper leg 14 when the upper leg 14 is fully inserted into the leg holder 34 and a person is sitting on the stool 10. In this way, the leg holder 34 not only supports the upper leg 14 but also increases the strength of the upper leg inserted into the leg holder 34. The lower end 40 has a round inner wall section 48 and a flat inner wall section 50. As explained below, the flat section 50 ensures that the lower leg 18 is properly turned before the lower leg can be inserted into the lower end 40.

Figure 6:
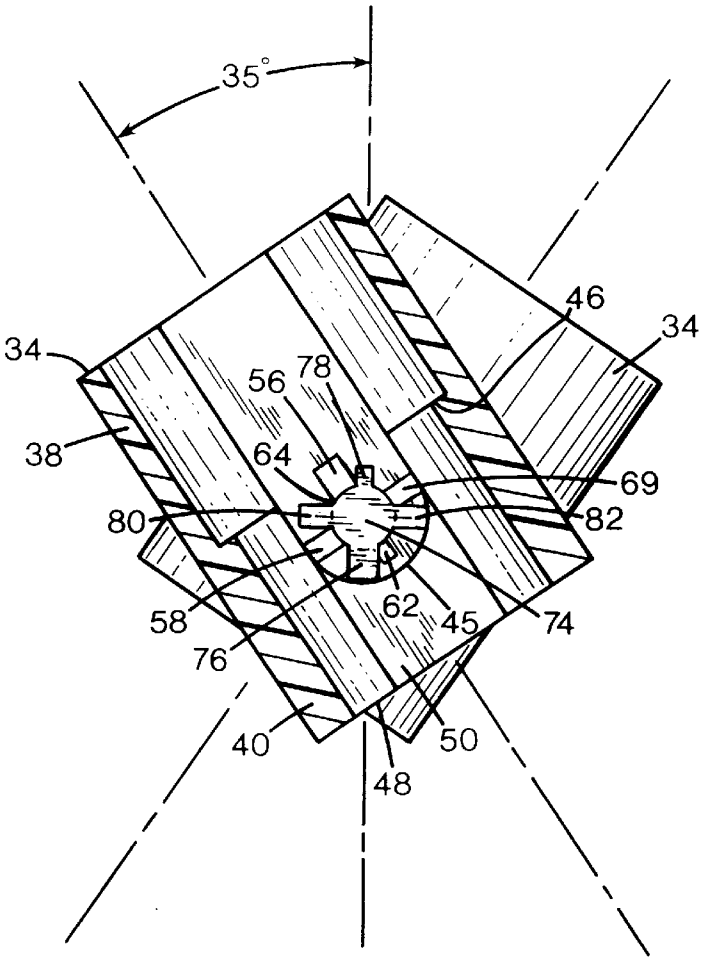
FIG. 6 is a cross-sectional side view of a first leg holder that is turned relative to a second leg holder.

Each leg holder 34 has an asymmetrically shaped lateral opening 52 defined therein. Each lateral opening 52 is defined in a curved protrusion section 54 of the leg holder 34. The lateral opening 52 is irregular because it has a square upper cavity 56 defined at an upper end of the lateral opening 52. The lateral opening 52 has diametrically opposed side cavities 58, 60 and a lower cavity 62. The upper cavity 56 is both longer and wider than the lower cavity 62. The holder 34 has guide members 64 disposed between the cavities that provide an important support when the foldable stool is in the expanded position, as shown in FIGS. 1 and 6.

A second lateral opening 67 is defined on an outside of the leg holder 34. A shallow groove 69 is defined by the holder 34 at the second lateral opening 67 so that it is easy to access the opening 67 with a finger.

A Y-shaped connector or joint member 68 is disposed between the three leg holders 34 to rotatably hold the holders 34 together, The joint member may be made of zinc or any other suitable sturdy material. The joint member 68 has three outwardly protruding extensions 70. The extensions extend outwardly at an angle that is about 120 degrees relative to one another. Each extension 70 has a radial groove 72 disposed therein and a locking mechanism 74 disposed at an outer end of each extension 70. An inner portion of the groove 72 is slanted at an angle, such as about 45 degrees. This 45 degree angle improves the strength of the extension 70 and ensures that the extension is firmly held to the leg holder 34. The locking mechanism 74 has a lower wing member 76 that extends radially downwardly from the extension 70 and an upper member 78 that extends radially upwardly from the extension 70. Between the lower and upper wing members 76, 78 are side wing members 80, 82 that extend sideways from the extension 70 so that the members are perpendicular to one another. The lower wing member 76 is both longer and wider than the upper member 78 and is dimensioned to snugly fit into the relatively large upper cavity 56 of the holder 34. Similarly, the upper wing member 78 is dimensioned to snugly fit into the lower cavity 62 and the side wing members 80, 82 fit into the side cavities 58, 60. The large size of the wing member 76 adds strength to the connector 68 and ensures that the leg holder 34 is securely held to the connector 68.

Figure 5:
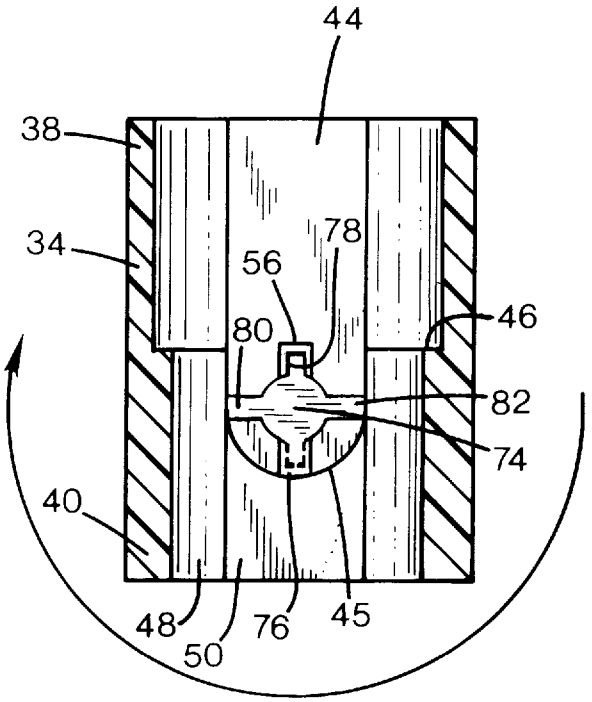
FIG. 5 is a cross-sectional side view of a portion of a leg holder of the present invention.
Figure 4:
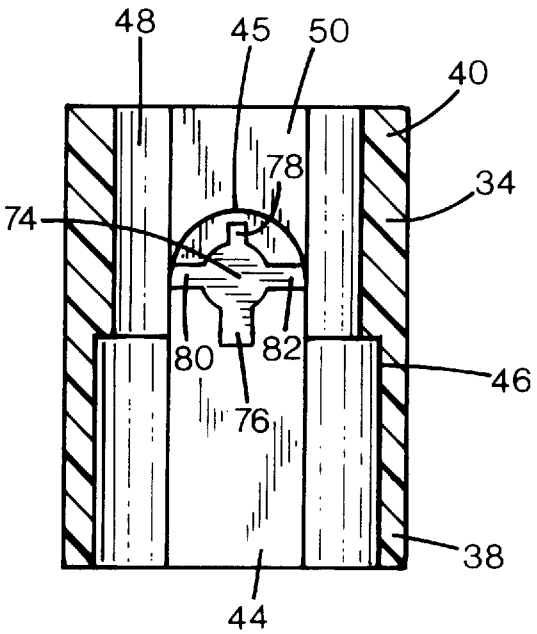
FIG. 4 is a cross-sectional side view of a portion of a leg holder of the present invention.
Figure 7:
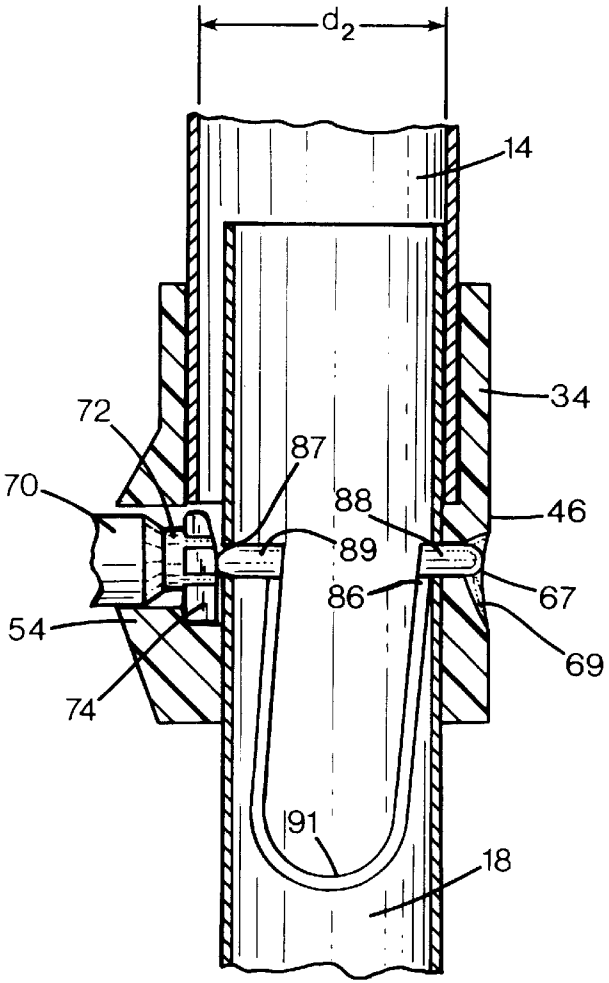
FIG. 7 is a cross-sectional side view of a lower leg inserted into an upper leg supported by a leg holder.

In this way, the extension 70 may only be inserted into the lateral opening 52 of the holder 34 (as best shown in FIG. 4) when the lower wing member 76 is aligned with the upper cavity 56 and the upper wing member 78 is aligned with the lower cavity 62 and the side wing members 80, 82 with the side cavities 58, 60. When the extension 70 is fully inserted into the later opening 52 (as best seen in FIGS. 4 and 7), it may be rotated about 180 degrees (as best seen in FIG. 5) because the radial groove 82 is rotatable within the lateral opening 52 while the extension wing members 76, 78, 80 and 82 are locked behind the inner wall at the lateral opening 52 of the leg holder 34. When the leg holder is turned, the lower wing member 76 and the side wing members 80, 82 may bear against the semi-circular end section 45 to provide added strength and support to the stool. By turning the leg holder 34 about 180 degrees, the upper end 38 of the leg holder 34 is turned upwardly and is ready to receive the bottom end of the upper leg 14. An important feature is that the extension 70 has a length that so dimensioned that when the extension is fully inserted into the lateral opening 52, the extensions 70 do not extend too far into the opening 36 to interfere with the lower leg 18. When the extension 70 is fully inserted, the extension is substantially flush with the flat inner wall 50.

Each lower leg 18 is an elongate hollow cylinder having one flat surface 84 extending along the lower leg 18. The lower leg 18 is dimensioned to tightly fit into the opening 36 at the lower end 40 of the leg holder 34 when the flat surface 84 is facing the flat inner wall 50 of the holder 34. The lower leg 18 has a diameter that is less than an inner diameter of the upper leg 14 so that the lower leg 18 may be inserted into the hollow upper leg 14 and the lower leg does not rub unnecessarily against the inner wall of the upper leg 14.

A pair of diametrically opposed openings 86, 87 are defined at an upper end of the lower leg 18 that outer and inner nipples 88, 89 may extend therethrough. The nipples 88, 89 may be spring biased by a bent plastic member 91 that is biasing the nipples outwardly through the openings 86, 87. When the lower leg 18 is inserted into the lower end 40 of the holder 34, the nipple 88 is permitted to snap into the second lateral opening 67 of the holder 34. The nipple 89 is permitted to snap into a cavity that is formed between the joint member 68 and the inner wall of the holder 34. This ensures that the lower leg 18 is not inserted too far into the holder 34. The cavity in the joint member 68 should be relatively shallow so that the nipple may slip into and out the cavity without much effort. The fact that the nipple 89 is not permitted to snap into a deep cavity transfer some of the biasing force to the nipple 88 to ensure that the nipple 88 fully penetrates the second lateral opening 67. When the lower leg 18 is fully inserted into the upper leg 14 (as shown in FIG. 2) to fold the stool 10 into the collapsed position, the nipples 88, 89 prevent the lower leg 18 from sliding out of the upper leg 14 because the nipples 88, 89 bear against the inner wall of the upper leg 14. The nipples 88, 89 also ensure that the lower leg 18 is securely held to the holder 34 when a person sits on the stool 10 so that the stool does not collapse, as shown in FIG. 7. A bottom end of each lower leg 18 includes a rubber cover 90 that is attached thereto.

When the upper leg 14 is fully inserted into the opening 36 of the upper end 38 of the holder 34 and rests on the flange 46, the lowermost end of the upper leg 14 is disposed above the lateral opening 52 so that the nipples 88, 89 may extend outwardly without interfering with the upper leg 14. By pressing in the nipple 88 to disengage the nipple 88 from the second lateral opening 67, the lower leg 18 may either be fully inserted into the upper leg 14 to move the stool 10 into the collapsed position or the lower leg 18 may be pulled out of the holder 34 to, for example, clean the leg holder 34 or completely disassemble the stool 10.

If it is desirable to move the foldable stool from the collapsed position to the expanded position, the strap 30 is first unsnapped and the lower legs are pulled out of the upper legs until the nipples snap into the second lateral openings 67 and the lower legs 18 are separated until the seat portion 12 is stretched and the protrusions 54 of the leg holders 34 bear against one another. The leg holders 34 now form an angle that is about 35 degrees relative to a vertical line so that the rubber covers 90 stand firmly on the floor or ground. An important feature of the present invention is that all the wing members are supported by the leg holders 34 when the stool 10 is in the fully expanded position. In other words, no wing member is positioned over the asymmetrical cavities of the later opening 52.

While the present invention has been described in accordance with preferred compositions and embodiments, it is to be understood that certain substitutions and alterations may be made thereto without departing from the spirit and scope of the following claims.

We claim:

1. A foldable stool, comprising:

a seat;

upper legs attached to the seat;

leg holders each having a longitudinal opening defined therethrough, each leg holder defining a first lateral opening having an asymmetrical shape, a portion of the upper legs being inserted into the longitudinal openings;

a connector having asymmetrically shaped extensions extending outwardly from the connector into the leg holders, the connector pivotally joining the upper legs together by means of the extensions, the asymmetrically shaped extensions being insertable into the asymmetrically shaped first lateral openings when the leg holders are turned into a first position to permit insertion of the extensions into the first lateral openings, the leg holders being rotatable into a second position to pivotally attached the leg holders to the connector, the second position being different from the first position; and lower legs being insertable into the longitudinal openings of the leg holders.

2. The foldable stool according to claim 1 wherein each leg holder has an inner wall with a flange to support the upper legs that are inserted into the leg holders when the leg holders are in the second position.

3. The foldable stool according to claim 1 wherein each leg holder has a second lateral opening defined at an outside portion of the leg holder that is diametrically opposed an inside position of each of the first lateral opening, each lower leg has a spring biased knob that is snapped into the second lateral openings when the lower legs are inserted into the leg holders.

4. The foldable stool according to claim 3 wherein the lower legs are inserted inside the upper legs when each spring biased knob is snapped into each second lateral opening.

5. The foldable stool according to claim 1 wherein the leg holders have an inner wall with a flat surface and the lower legs have a flat surface so that the lower legs are only permitted to be inserted into the leg holders when the flat surface of each inner wall is facing each flat surface of the lower legs.

6. The foldable stool according to claim 1 wherein the foldable stool is movable from a collapsed folded position to an expanded position, the leg holders are turned about 35 degrees relative to a vertical line L when the foldable stool is in the expanded position.

7. The foldable stool according to claim 6 wherein the lower legs are fully inserted into the upper legs when the foldable stool is in the collapsed folded position.

8. A foldable stool, comprising:

a seat;

upper legs attached to the seat, each upper leg having a bottom end;

leg holders having longitudinal openings defined therethrough, the leg holders having first lateral openings defined therein, the upper legs being operatively attached to the leg holders;

a Y-shaped connector having outwardly extending extensions, the extensions being insertable into the first lateral openings when the leg holders are turned into a first position to permit insertion of the extensions into the first lateral openings, the leg holders being rotatable into a second position to pivotally hold the leg holders to the Y-shaped connector, the second position being different from the first position, the Y-shaped connector being disposed below the bottom ends of the upper legs when the upper legs are fully inserted into the leg holders; and lower legs in operative engagement with the leg holders.

9. The foldable stool according to claim 8 wherein the lower legs are partially inserted into the upper legs.

10. The foldable stool according to claim 8 wherein the first lateral openings have an asymmetrical shape so that the extensions are only insertable into the first lateral openings when the leg holders are in the first position.

11. The foldable stool according to claim 8 wherein each leg holder has an upper portion and a lower portion, each upper portion has an inner diameter that is greater than an inner diameter of the lower portion to permit insertion of the upper legs into the upper portions, the upper legs have an outer diameter that is greater than an outer diameter of the lower legs.

12. The foldable stool according to claim 8 wherein each extension has radially protruding wings that tightly fit into cavities defined in the leg holders.

13. The foldable stool according to claim 12 wherein the leg holders have a semicircular cavity defined therein and the protruding wings bear against the semicircular cavity when the leg holders are moved from the first position to the second position.

14. The foldable stool according to claim 12 wherein the protruding wings comprises an upper wing that is longer and wider than a diametrically opposed lower wing.

15. A foldable stool, comprising:

a seat;

upper legs attached to the seat;

leg holders each having a longitudinal opening defined therethrough, the leg holders each having a first lateral opening defined therein, a portion of each upper leg being inserted into the longitudinal openings;

a connector having extensions, the extensions being insertable into the first lateral openings when the leg holders are turned into a first position, the leg holders being rotatable into a second position that is different from the first position so that the leg holders are securely held to the connector and the leg holders are in operative engagement with the upper legs; and lower legs insertable into the leg holders, the leg holders each having an inner wall, the connector being substantially flush with the inner wall when the connector is fully inserted into the first lateral openings.

16. The foldable stool according to claim 15 wherein the foldable stool is movable between an collapsed position and an expanded position, the connector having a locking mechanism attached to each extension, the locking mechanism being captured between the leg holders and the lower legs when the foldable stool is in the expanded position.

17. The foldable stool according to claim 15 wherein the lower legs are removably inserted into the leg holders.

18. The foldable stool according to claim 15 wherein the upper legs are removably inserted into the leg holders.

* * * * *